United States Patent [19]

Israel et al.

[11] Patent Number: 4,746,909

[45] Date of Patent: May 24, 1988

[54] MODULAR SECURITY SYSTEM

[75] Inventors: Marcia Israel, 7710 Haskell Ave., Van Nuys, Calif. 91406; Leo R. Close, Sepulveda, Calif.

[73] Assignee: Marcia Israel, Van Nuys, Calif.

[21] Appl. No.: 902,484

[22] Filed: Sep. 2, 1986

[51] Int. Cl.[4] ..... G08B 13/12

[52] U.S. Cl. ..... 340/568; 340/687

[58] Field of Search ..... 340/568, 652, 571, 572, 340/687

[56] References Cited

U.S. PATENT DOCUMENTS

| | | | |
|---|---|---|---|
| 3,596,265 | 7/1971 | Garland | 340/568 |
| 3,972,039 | 7/1976 | Marshall | 340/568 |
| 4,069,919 | 1/1978 | Fernbaugh | 340/568 |
| 4,132,987 | 1/1979 | Devereaux | 340/568 |
| 4,327,360 | 4/1982 | Brown | 340/568 |
| 4,620,182 | 10/1986 | Keifer | 340/568 |

FOREIGN PATENT DOCUMENTS 1435944 5/1976 United Kingdom .

*Primary Examiner*—Glen R. Swann, III

*Assistant Examiner*—Tat K. Wong

*Attorney, Agent, or Firm*—Bogucki, Scherlacher, Mok & Roth

[57] ABSTRACT

An electronic security system for monitoring merchandise and the like is provided which is responsive to any change of state in the electrical connections thereto thus providing for the detection of virtually any tampering with the merchandise or security system. Conductive loop sensors attached to the merchandise are releasably coupled to series-connected modular sensor monitoring units which in turn are connected to a single control box enclosing latching and alarm circuits. Each monitoring unit is preferably adapted to receive a plurality of conductive loops. Severing of any of the loops, as well as disconnection or reconnection of the loops, the monitoring units or the control box activates the alarm. A time-out circuit controls the length of time of alarm activation and is switchable between long and short alarm durations.

Means facilitating the mounting of the manifold units and control box on existing T-stand and wall rack clothing displays, are also disclosed.

27 Claims, 8 Drawing Sheets

MODULAR SECURITY SYSTEM

BACKGROUND OF THE INVENTION

1. Field of the Invention

The present invention relates to security systems for merchandise on display such as articles of clothing, and more particularly to electrical security systems in which alteration of a wire loop extending through a portion of an article secured thereby activates an alarm.

2. History of the Prior Art

A variety of different types of security systems have been proposed for securing merchandise on display such as articles of clothing. In a typical retail store, for example, it is desirable to secure popular and expensive items against the possibility of shoplifting.

Security systems for merchandise include mechanical systems as well as electrical systems. Mechanical systems typically secure the merchandise using a length of cable, chain or the like. In the case of a coat, for example, a length of chain or cable is passed through the sleeve and then secured such as by use of a lock or similar device to form an endless loop. The coat cannot be removed by a potential thief without cutting or otherwise breaking the cable or chain. Many security systems of the electrical type couple a wire or other electrical conductor to the merchandise. If the wire is cut or otherwise broken, an alarm is activated to signal the unauthorized removal of the article.

Examples of mechanical security systems are provided by U.S. Pat. Nos. 3,690,130; 4,336,885; 4,300,690; and 4,204,601. The first two patents described arrangements in which chains attached to the merchandise are passed through slots in the sides of a closable box and then positioned over pegs within the box. The box itself is secured, and the chains cannot be removed from the box without unlocking and opening the box. The latter two of the four patents noted described arrangements in which cables or other restraining devices are secured within slots in the side of a box. A key is required to open the box to permit removal of the restraining devices therefrom.

Mechanical security systems which utilize chains, cables and the like are less than ideal for many applications. Besides being a nuisance to install upon initial display of the merchandise and to remove upon sale of the merchandise or in some cases simply to permit trying on of the merchandise, such devices are easily broken, cut or otherwise defeated by the sophisticated thief. For these reasons electronic security systems present a more attractive alternative for many applications. Typically, electronic security systems employ a wire loop or other sensing device which provides an electrical signal when the loop is cut, broken or otherwise tampered with. The electrical signal in turn is applied to activate an alarm. Such systems tend to be compact, lightweight and easy to install, and quite versatile. The configuration of the wire loops or other sensing devices can be readily varied to adapt to different merchandise displays and different types of merchandise. The alarm may involve sound, a visual signal, a silent signal in a remote location or other possibilities.

Examples of electronic security systems are provided by U.S. Pat. Nos. 883,335; 4,609,919; 2,913,713; 3,253,270; 3,444,547; 3,972,039; and 4,234,879. U.S. Pat. No. 883,335 describes an arrangement in which a plurality of wire loops are coupled in series. The breaking of a loop actuates solenoids and switches to activate an alarm. The circuit has a bypass provision enabling the removal of the sensor loops without triggering the alarm. U.S. Pat. No. 4,069,919 describes an arrangement of serially coupled loops in which apparatus is provided for maintaining circuit continuity so as to prevent activation of an alarm when a loop is absent as well as when both of the enlarged heads of a loop are present in the apparatus. In the arrangement described in U.S. Pat. No. 2,913,712 a single loop is provided with multiple connectors for varying the length thereof so as to accommodate a variety of objects to be secured. In the arrangement described in U.S. Pat. No. 3,253,270 in which plural loops are coupled in parallel, the circuit thereof is initially balanced using a potentiometer. Thereafter, cutting or shorting of a loop unbalances the circuit so as to activate an alarm. Each loop has a plug and jack connection. U.S. Pat. No. 3,444,547 describes an arrangement in which each loop is comprised of a coaxial cable, the inner conductor of which provides a disconnect signal via a latching relay and the outer conductor of which provides a short circuit signal. U.S. Pat. No. 3,972,039 describes a three-wire system which allows loops to be added without activating the alarm. The alarm is activated in the event of removal of a loop plug, the cutting of a loop, or a short circuit. In the arrangement described in U.S. Pat. No. 4,234,879, a loop is connected by plugging into the side of a box.

While present electrical security systems such as those described in the patents referred to are advantageous over mechanical security systems in various respects, such systems leave room for improvement in a number of other respects. For one thing, most such systems are highly complex and specialized in nature in that they respond to only one or a limited number of conditions such as the breaking or other disconnection of a wire loop. It would be better, in this respect, to provide a system of relatively simple design and which would be responsive to any change of state in the circuitry thereof including the connection of a loop thereto as well as the disconnection of a loop coupled thereto. Most electrical security systems are limited in terms of their size and the arrangement thereof to accommodate a variety of different merchandise displays. In this connection it would be advantageous to provide a modular system which involves but a handful of basic components which are readily interconnected with removable connectors and which are easily added to or removed from the system so as to adapt the system to any one of a variety of different applications. Still further advantages would be realized from a security system in which the modular components thereof are mounted such as by special brackets for ease of installation of the system in typical merchandise display arrangements such as T-stands and wall mount arrangements.

BRIEF DESCRIPTION OF THE INVENTION

These and other objects are accomplished in accordance with the invention by an electronic security system which is responsive to any change of state in the electrical connections thereto, which is modular in nature and which is easily installed in and removed from common merchandise display arrangements. The system employs relatively simple circuitry for sensing a change of state in any one of a plurality of conductive sensor loops, including the connection, disconnection or short circuiting of a loop. The system is modular in nature, being comprised of but a handful of basic components which are coupled together by releasable connectors and which are added to the system as necessary to expand the system or make the system usable in a variety of different applications. Specially designed clips and brackets are provided so that the components of the modular system are easily installed in and removed from typical merchandise display arrangements such as a T-stand and a wall mount arrangement for displaying articles of clothing.

In a preferred embodiment of a modular electronic security system in accordance with the invention each of a plurality of sensors in the form of conductive loops physically interconnects with an article of merchandise to be secured. The sensor loops are coupled to one or more multi-channel sensor monitoring units, or manifold units, each of which includes a binary detection circuit which is operative to provide a change of state signal whenever a change of state occurs in any of the electrical circuits coupled thereto. The detection circuit preferably includes at least one exclusive OR circuit for producing the change of state signal in response to a change in the signal condition at either of a pair of inputs thereof. The manifold units are coupled to provide a change of state signal generated thereby to a common control box which includes an alarm and a bistable latching circuit for activating the alarm in response to the change of state signal. The bistable circuit, which in its preferred form comprises a flip-flop circuit, normally assumes a first state. Upon receipt of a change of state signal from one of the manifold units, the bistable circuit is changed to a second state to activate the alarm. A time-out circuit within the control box holds the bistable circuit in the second state and thus the alarm activated for a predetermined period of time, following which the bistable circuit returns to the first state. Switching means are provided for selecting between two different intervals of alarm activation.

Electronic security systems in accordance with the invention are modular in nature in that they comprise but a handful of basic components which are coupled together using releasable connectors. A single control box which contains the bistable circuit, the alarm and the time-out circuit can be coupled to one or more of the manifold units as determined by the installation. The manifold units which must be located relatively close to groups of merchandise articles being displayed may be coupled to the common control box either in series or in parallel using releasable connectors such as standard plugs and jacks. Each manifold unit has one or more wire loops coupled thereto using standard plugs and jacks. Each loop itself includes a releasable connector in the form of a plug and jack for completing the loop after the cable thereof is passed through an article of merchandise to be secured.

Manifold units can easily be added to expand a single system to accommodate virtually any number of sensor loops. The manifold units are connected in series thereby eliminating the need to connect each one to the control box. This minimizes the wiring and makes for a neater and less conspicuous installation. Moreover, a single cable containing only four conductors connect the units to each other. The ability to add units in series and the minimization of the number of conductors are made possible by the distributed circuitry. The detector circuits are carried by the individual loop monitoring or manifold units and these circuits detect not only a change of state of the loops or circuitry in the given manifold unit but in any unit attached to the input. The remainder of the circuitry, including latching and alarm circuits, is housed in the control box. Thus, only a single control box is needed to monitor a large number of manifold units. Moreover, the detection circuitry is designed so as not to require manual resetting to an initial state. The system makes use of digital CMOS logic circuitry which draws very little current. Accordingly, the system can be battery operated and is completely self contained.

Virtually any change in the system will generate an alarm signal. Alarm conditions include severing or disconnection of any of the sensor loops; connection of a sensor loop to a manifold unit; connection or disconnection of a manifold unit to or from another manifold unit or the control box; and a power failure in any of the manifold units. An alarm is also generated when the unit is powered up, for example, when a replacement battery is inserted.

When a loop sensor is removed from the monitoring unit by authorized personnel such as would occur when the protected article is sold to a customer, an inconspicuous switch on the control box is moved to activate a short duration time-out circuit. The abbreviated signal then generated upon removal of the loop sensor is an indication to sales personnel that the system is functioning properly.

BRIEF DESCRIPTION OF THE DRAWING

The foregoing and other objects, features and advantages of the invention will be apparent from the following more particular description of preferred embodiments of the invention, as illustrated in the accompanying drawing, in which.

DETAILED DESCRIPTION

Figure 1:
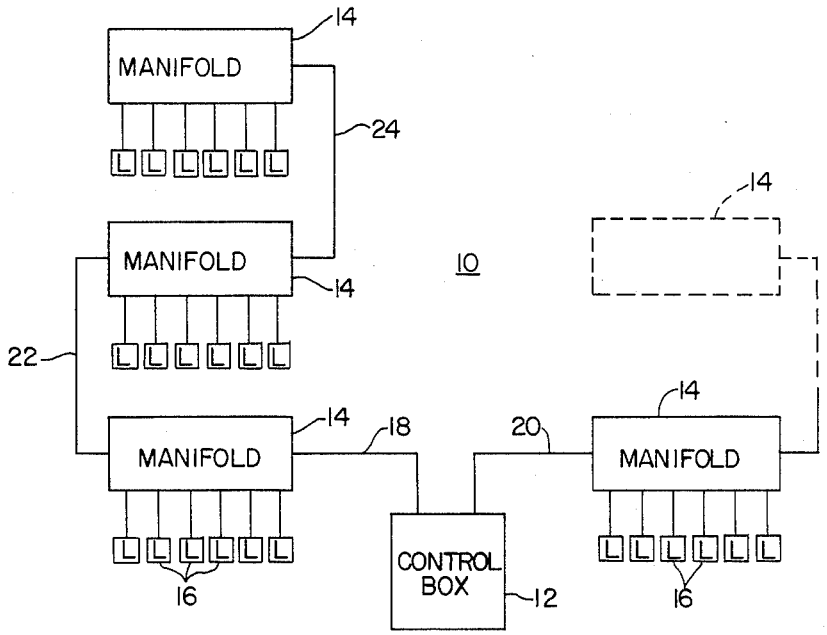
FIG. 1 is a block diagram of a modular electronic security system in accordance with the invention.

FIG. 1 depicts a modular electronic security system 10 in accordance with the invention. The security system 10 includes a single control box 12 which is shared by a plurality of multi-channel sensor monitoring or manifold units 14. Each manifold unit 14 is adapted to have coupled thereto up to six conductive sensor loops 16 (designated "L" in FIG. 1).

Each of the loops 16 is coupled to an article of merchandise to be secured by the security system 10. In the case of an article of clothing the loop 16 is passed through a sleeve, trouser leg or other portion of the article of clothing so that the article of clothing cannot be removed without disconnecting the loop 16. Each manifold unit 14 is operative to sense a change in the state in any one of the loops 16 coupled thereto. In accordance with the invention the manifold unit 14 is operative to sense any change of state in the circuits formed by the associated loops 16 including the coupling of a loop 16 thereto as well as the removal of a loop 16 or the opening or breaking of a loop 16. The manifold unit 14 responds to such a change in the state by providing a change of state signal to the control box 12. As described hereafter the control box includes an alarm together with circuitry for activating the alarm in response to the change of state signal. Such circuitry keeps the alarm activated for a predetermined period of time following which the alarm is then deactivated and the system reset.

The modular nature of security systems in accordance with the invention and the adaptability thereof to different display arrangements is illustrated by the security system 10 of FIG. 1. The single control box 12 can be used with one or more of the manifold units 14. Each manifold unit 14 is mounted in a location where up to six articles of merchandise are to be secured. The manifold units 14 may be coupled to the control box 12 either in series or in parallel. As shown in FIG. 1 three of the manifold units 14 in the left hand portion thereof are coupled in series to the control box 12, and such coupling is in parallel with a single manifold unit 14 in the right hand portion of FIG. 1. As shown by the dashed lines in FIG. 1, one or more additional manifold units 14 could be coupled in series with the manifold unit 14 shown in the right hand portion of FIG. 1, if desired.

As described in detail hereafter the manifold units 14 are coupled to each other and to the control box 12 using releasable cables of standardized configuration. FIG. 1 depicts cables 18 and 20 coupling the control box 12 to two of the manifold units 14, and cables 22 and 24 coupling three of the manifold units 14 in series. The various cables 18, 20, 22 and 24 are provided at the opposite ends thereof with plugs which are received in jacks mounted on the control box 12 in the manifold units 14. Preferably, the plugs and jacks are of the standard telephone modular type. Each of the loops 16 is formed using standardized plug and jack connections and is coupled to one of the manifold units 14.

The modular nature of the security system 10, which is enhanced by use of the releasable cables 18, 20, 22 and 24 providing for quick connection and disconnection of the system components, is facilitated by the manner in which the functions are distributed throughout the security system 10. Each of the manifold units 14 functions to sense a change of state in any of the circuits formed by the loops 16 attached thereto. In the present example each manifold unit 14 can be coupled to as many as six of the loops 16, although in actual practice each manifold unit 14 can be adapted for operation with a greater or lesser number of the loops 16 depending upon design considerations. The manifold units 14 are located throughout the display arrangement of merchandise so that each article of merchandise to be secured can have one of the loops 16 connected thereto. The manifold units 14 are connected either serially or in parallel, whichever is more convenient, to the control box 12. The entire security system 10 is served by the single control box 12. The circuitry within the control box 12 responds to a change of state signal from any of the manifold units 14 to activate the alarm. Also, as described hereafter, the control box 12 contains the entire source of power for the security system 10 in the form of a single battery, thereby eliminating the need for external connection of the security system 10 outside of the display arrangement in which it is installed.

Figure 2:
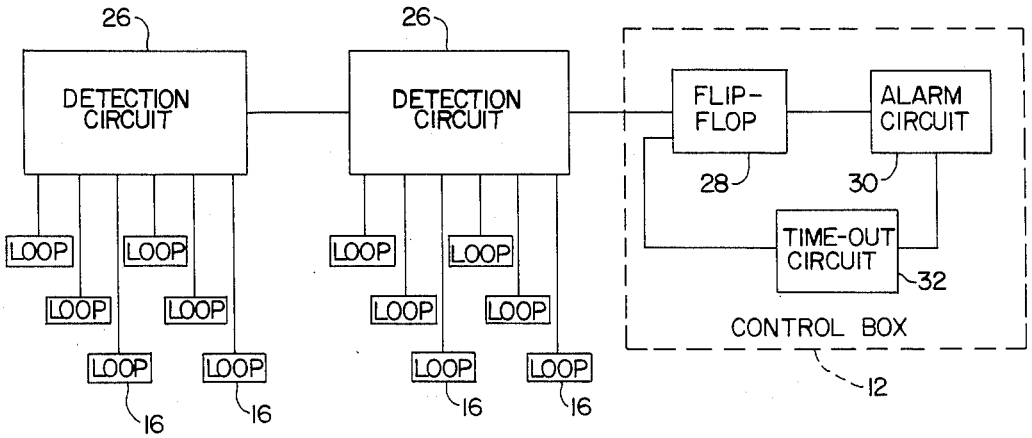
FIG. 2 is a block diagram showing portions of the system of FIG. 1 in greater detail.

A portion of the security system 10 of FIG. 1 is shown in greater detail in FIG. 2. FIG. 2 depicts two of the manifold units 14 coupled in series to the control box 12. Each of the manifold units 14 contains a multi-channel detection circuit 26. Each channel is associated with a different one of the loops 16. The control box 12 includes a flip-flop 28 having a "set" input coupled to the multi-channel detection circuits 26 and an output coupled to an alarm circuit 30. The alarm circuit 30 in turn is coupled through a time-out circuit 32 to a "reset" input of the flip-flop 28.

In operation, each of the detection circuits 26 in FIG. 2 provides a change of state signal at the "set" input of the flip-flop 28 whenever a change of state occurs in one of the six loops 16 coupled thereto, or in any of the loops attached to a manifold unit connected as an input the detection circuit of a given manifold unit. The circuit 26 provides a signal to the "set" input of the flip-flop 28 in response to any change of state including the coupling of a loop 16 to the circuit 26 as well as the uncoupling of a loop 16 from itself or from the circuit 26. The flip-flop, which normally assumes a first state, changes to a second state in response to a signal at the "set" input thereof. This activates the alarm 30 and at the same time initiates a predetermined time period by the time-out circuit 32. At the end of the predetermined time period, the time-out circuit 32 provides a signal at the "reset" input of the flip-flop 28 to change the flip-flop 28 back to the first state thereof and thereby deactivate the alarm 30. In actual practice, and as described hereafter, it is advantageous to provide the time-out circuit 32 with two different time intervals that can be selected by the flip of a switch. The longer time interval is normally chosen through appropriate positioning of the switch so that in the event of an actual theft or attempted theft the alarm 30 will sound long enough to provide adequate warning to store personnel. The shorter time interval is selected using the switch to provide a shorter alarm such as when an article of merchandise is removed upon sale thereof, during installation of the wire loops 16 upon addition of articles of merchandise to the display, and generally to test the functioning of the security system 10.

Figure 3:
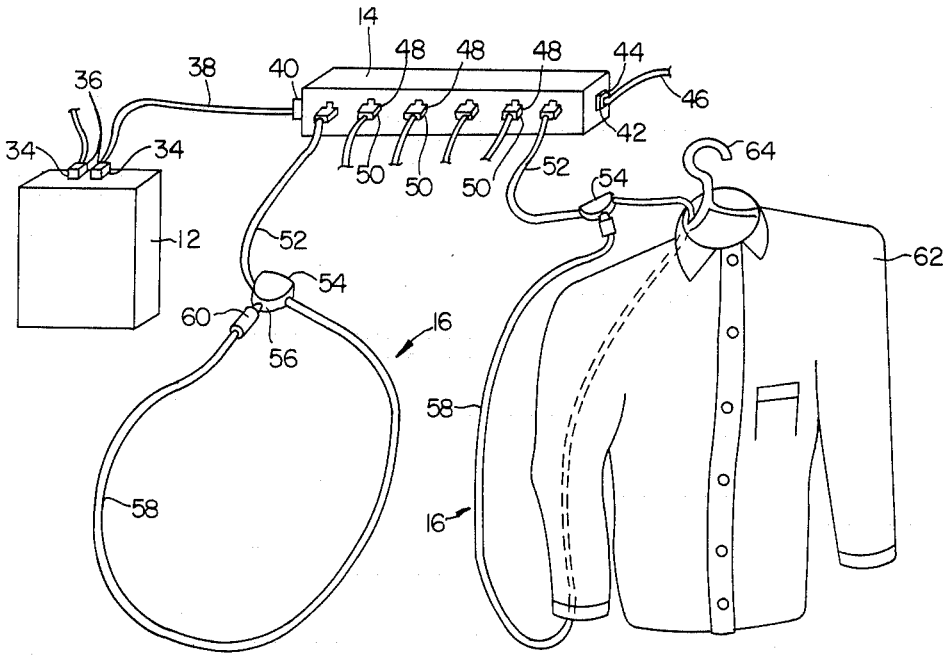
FIG. 3 is a perspective view of a portion of the system of FIG. 1 showing an article of clothing secured thereto.

FIG. 3 depicts the control box 12 together with one of the manifold units 14. As seen in FIG. 3 the control box 12 is of generally rectangular configuration and is provided at an upper end thereof with a pair of standard jacks 34 for receiving standard mating plugs 36. One of the plugs 36 forms a part of a releasable cable 38 having an output plug 40 at an opposite end thereof. The output plug 40 is received within an output jack (not shown) at one end of the elongated, generally rectangular housing of the manifold unit 14. An opposite end of the manifold unit 14 is provided with a like jack 42 serving as an input for receiving a plug 44 at the end of a cable 46 connected to another manifold unit 14 (not shown).

In the present example the control 12 is provided with the two jacks 34 so that the manifold box 12 can be coupled in parallel to at least two of the manifold units 14. However, the control box 12 can be provided with a single jack 34 or with more than two of the jacks 34 as desired. The manifold unit 14 is provided with jacks at both of the opposite ends thereof so that other manifold units 14 can be serially coupled through the manifold unit 14 to the control box 12.

Figure 4:
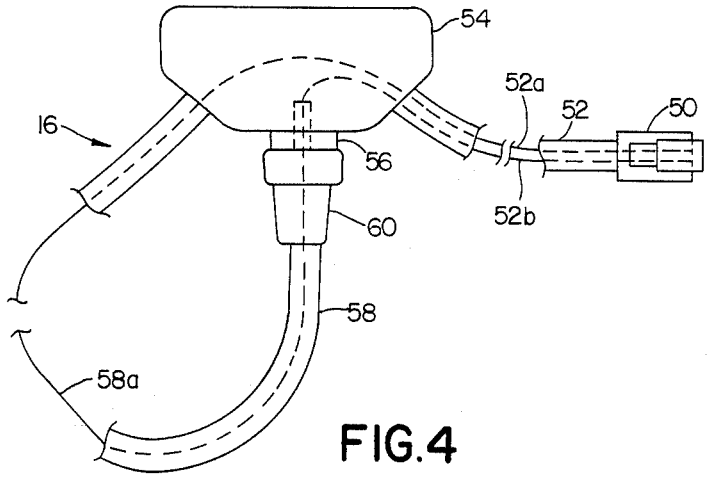
FIG. 4 shows a typical loop sensor in greater detail.

As shown in FIG. 3 the manifold unit 14 has six jacks 48 mounted in spaced-apart fashion along the length thereof. Each of the jacks 48 is adapted to receive a plug 50 of a different one of the loops 16. Two of the loops 16 are shown in FIG. 3; details of a typical loop are shown in FIG. 4. As described hereafter the plug 50 (comprising a standard modular telephone plug) of each loop 16 is coupled through a length of conductive cable 52 to a Y-connector 54 having a standard phono jack 56 therein. The cable 52 includes two wire conductors 52a, 52b. The loop 16 includes a further length of conductive cable 58 extending from the Y-connector 54 and terminating in a plug 60 of the standard phono type. The cable 58 has a single wire conductor 58*a*.

A typical interconnection of one of the loops 16 with an article of merchandise is shown in FIG. 3. The article of merchandise comprises a jacket 62 which is mounted on a hanger 64 so that the jacket 62 can be hung for display in a location close to the manifold unit 14. With the plug 60 removed from the jack 56 of the Y-connector 54, a length of cable 58 is passed through the collar and then out through the sleeve of the jacket 62. Thereafter the plug 60 is inserted into the jack 56 to complete a loop formed by the connector 54, the jack 56, the length of cable 58 and the plug 60. Because the security system 10 activates the alarm within the control box 12 in response to any change of state in any of the wire sensor loops 16, the alarm will be briefly activated when the plug 60 is inserted in the jack 56 following passage through the jacket 62. This simply alerts the clerk who is securing the jacket 62 to the fact that the security system 10 is working and the jacket 62 is properly secured. The control box is then switched by the clerk to the long duration alarm setting. Thereafter, should there by any change of state in the wire loop 16 such as would occur if the plug 60 is removed from the jack 56, if the length of cable 58 is severed, if the plug 50 is removed from the jack 48, or if the length of cable 52 is severed, the manifold unit 14 will respond by providing a change of state signal to the control box 12 which in turn will activate the alarm.

Figure 5:
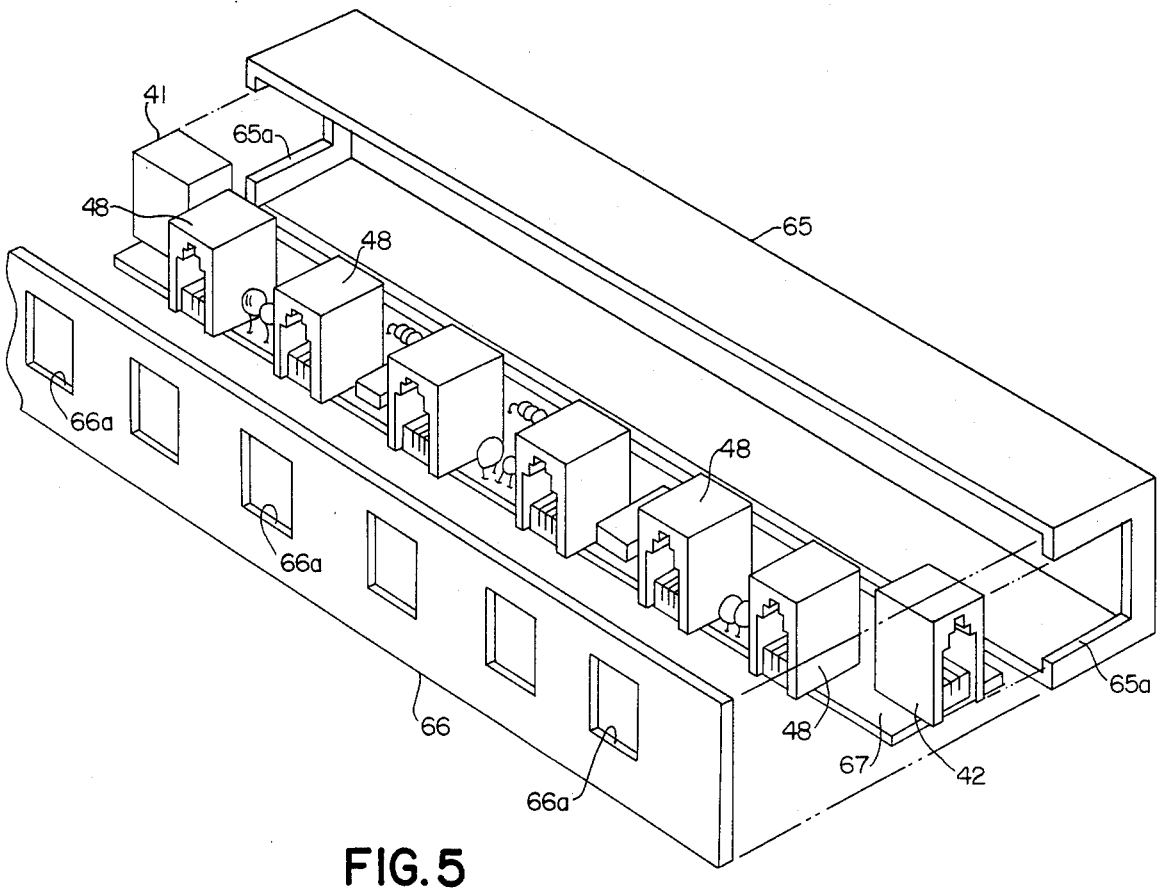
FIG. 5 is an exploded perspective view of one of the manifold units.

FIG. 5 shows a typical multi-channel loop sensor monitoring or manifold unit 14. The units 14 comprises a housing 65 and a front panel 66 having openings 66*a* providing access to the six sensor loop jacks 48 which, in accordance with the preferred embodiment, comprise standard modular telephone jacks. The unit 14 also includes an output jack 41 and an input jack 42 at opposite ends of the unit. The housing 65 includes end slots 65a for receiving the jacks 41 and 42. The jacks 41, 42 and 48 are all mounted on a circuit board 67 which also carries the components of the electronic detector circuit 26.

Figure 6:
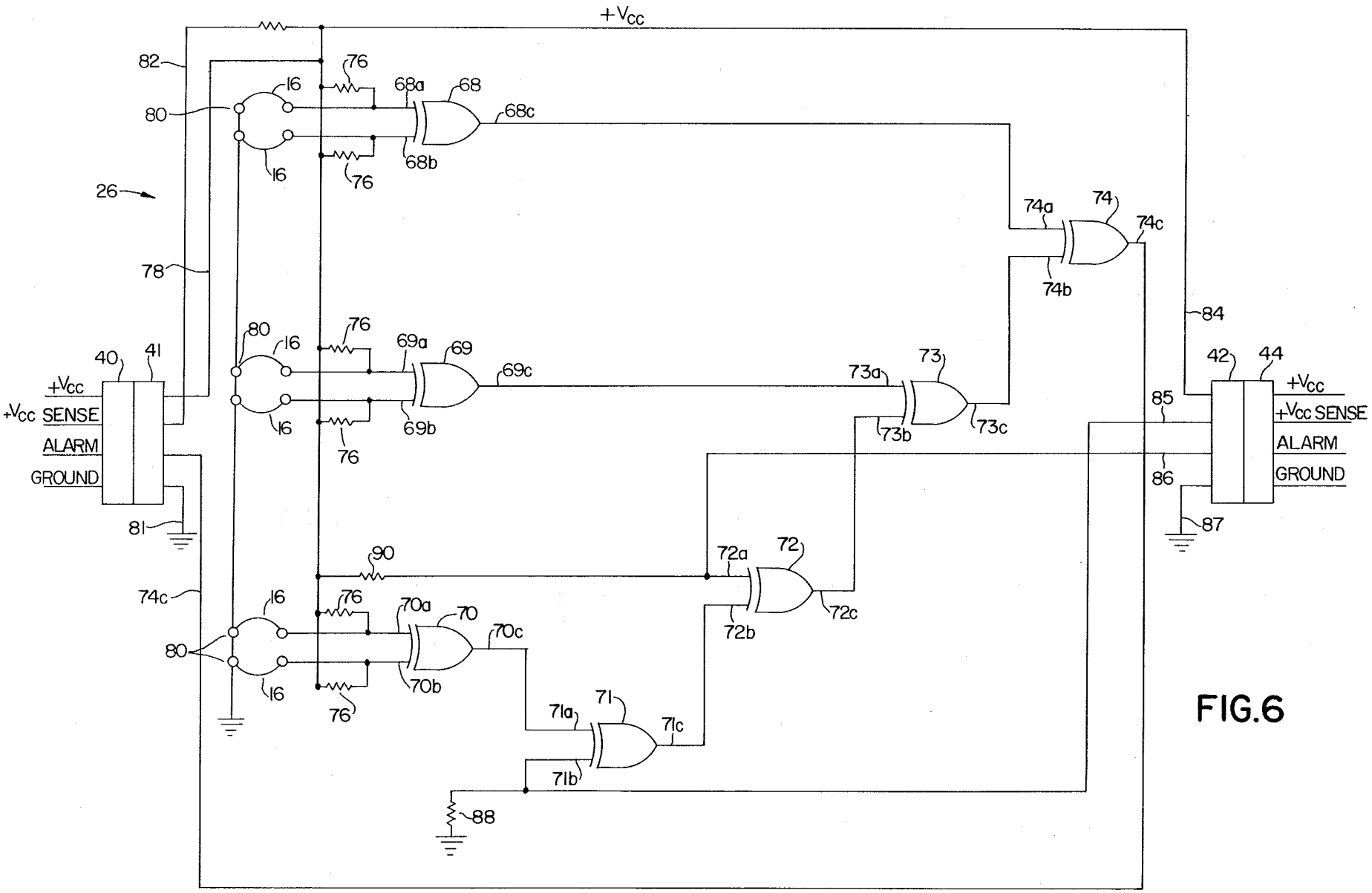
FIG. 6 is a schematic diagram of a detection circuit contained in each of the manifold units of the system of FIG. 1.

FIG. 6 is a schematic of a detection circuit 26 contained in one of the manifold units 14. The circuit 26 includes seven exclusive OR ("XOR") gates, 68–74 having inputs 68*a*, 68*b*; 69*a*, 69*b*; and so forth, and outputs 68*c*, 69*c*, 70*c*, etc., respectively. Output 74*c* is the alarm signal output of the circuit 26. Pull-up resistors 76 connected to $+V_{cc}$ power supply line 78 normally maintain the inputs of XOR gates 68–70 "high". The loops 16 are coupled between the individual inputs of the XOR gates and ground terminals 80. As already mentioned, and as shown in FIG. 6, each manifold can accommodate six loops. The presence of an intact loop 16 pulls the corresponding XOR gate input to a "low" state.

The circuit of FIG. 6 also includes a $+V_{cc}$ sense line 82 which monitors the state of the power supply which, for example, may be simply a nine volt battery.

The four lines 74*c* (alarm signal), 78 ($+V_{cc}$), 81 (ground) and 82 ($+V_{cc}$ sense line) are connected to the standard jack 41 (at the left in FIG. 6) which receives a plug 40 connected to another manifold unit 14 or to the control box 12.

The circuit 26 also includes a standard jack 42 for receiving a plug 44 from another manifold unit 14 (not shown in FIG. 6). The conductors 84–87 from jack 42 comprise, respectively, a $+V_{cc}$ line, a $+V_{cc}$ sense line, an alarm signal line and a ground line. The signal output line 86 is connected to input 72*a* of XOR gate 72 while the $+V_{cc}$ sense line 85 is connected to input 71*b* of XOR gate 71. A resistor 88 couples input 71*b* to ground so that in the absence of the second manifold unit, or in the event of a power failure associated with that second unit, this input is pulled "low".

In the operation of the circuit shown in FIG. 6, it will be assumed that initially (1) all six loops 16 are in place, (2) the output of the circuit 26 shown in FIG. 6 is coupled directly to the control box 12 via jack 41 rather than to another manifold unit, and (3) no other manifold unit is connected to the circuit 26 via jack 42. Accordingly, all of the inputs of gates 68–70 as well as their outputs will be "low". In the absence of a series connected, second manifold unit, input 72*a*, which is coupled to the power supply via a pull-up resistor 90, will be "high" while input 71*b* will be "low". Hence, output 71*c* will be "low" while outputs 72*c* and 73*c* will be "high". Inputs 74*a* and 74*b* of XOR gate 74 will therefore be "low" and "high", respectively, and the signal appearing at output 74*c* will be "high" given the initial states described. It will be seen that if any of the loops 16 is disconnected output 74*c* will change state. Further, if in the initial state of the circuit, one or more of the loops 16 is disconnected, an attempted reconnection of a loop will cause a change of state of the output 74*c*.

If a second manifold unit is connected to the first unit (whose circuitry is shown in FIG. 6) via the jack 42, a change of state of the alarm signal from that succeeding unit on line 86 will cause a change of state in the output 74*c*, as will a change in the $+V_{cc}$ sense line 85 (normally "high" with a second manifold in place).

It will thus be appreciated that according to the present invention, the output 74*c*, and therefore the alarm, is responsive to any change in condition irrespective of the initial state of the loops 16 or related circuitry. Such change in state will occur if a connected loop 16 is disconnected, if a disconnected loop is connected, if a disconnected battery power supply is reconnected, if a manifold unit is added or removed, and so forth. Virtually any tampering whatsoever with the system is therefore detected.

Furthermore, by distributing the circuitry between the control box and the manifold units in the manner shown and described herein, the series connection of "daisy-chaining" of virtually any number of manifold units 14 is facilitated with a minimum number of condutors between units. The direct connection of each manifold unit to the control box may be therefore avoided. In addition, the control box circuitry, described below, does not have to be reset to a particular initial state.

Figure 7A:
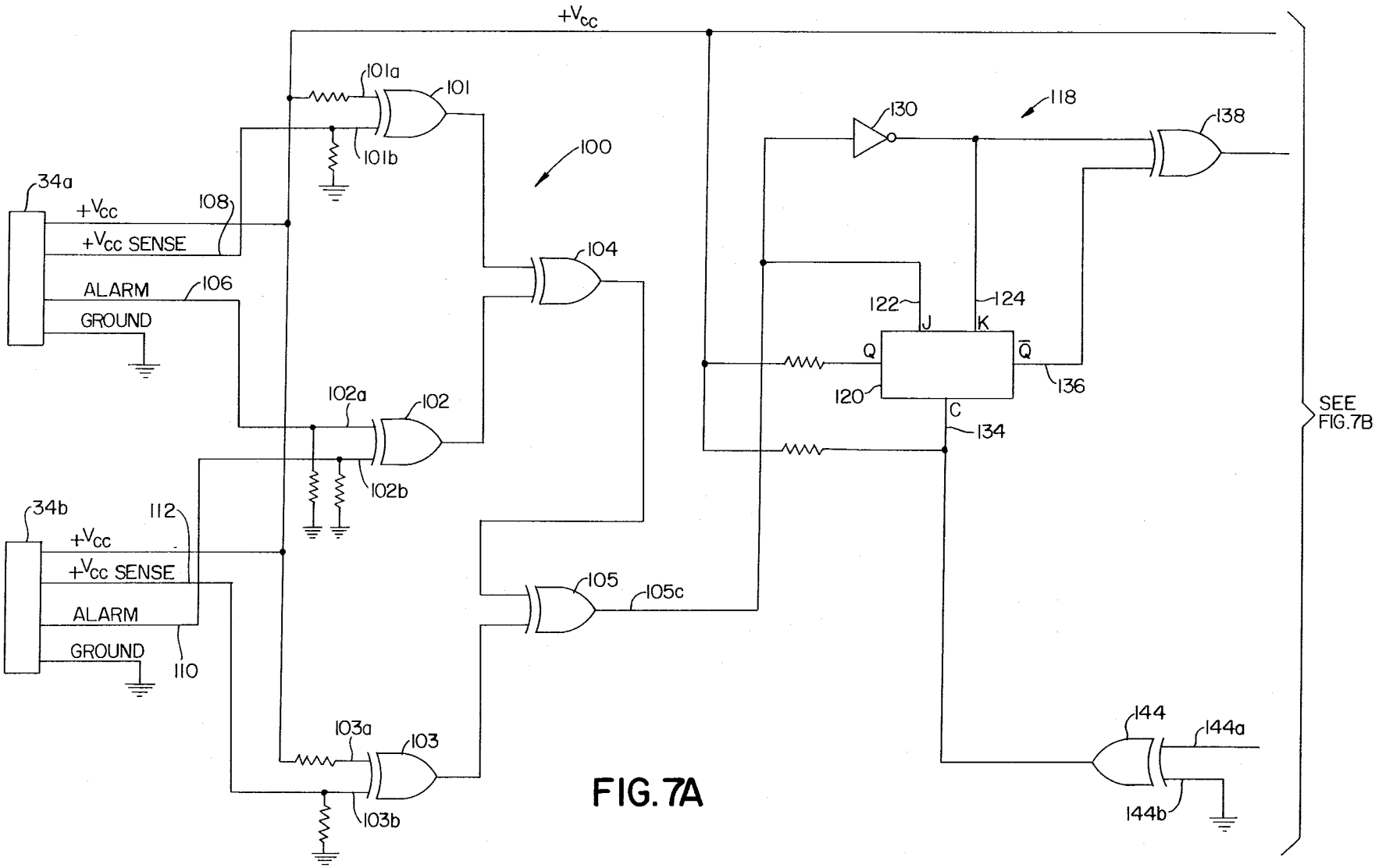
FIGS. 7A and 7B together comprise a schematic diagram of the flip-flop and alarm circuits within the control box of the system of FIG. 1.
Figure 7B:
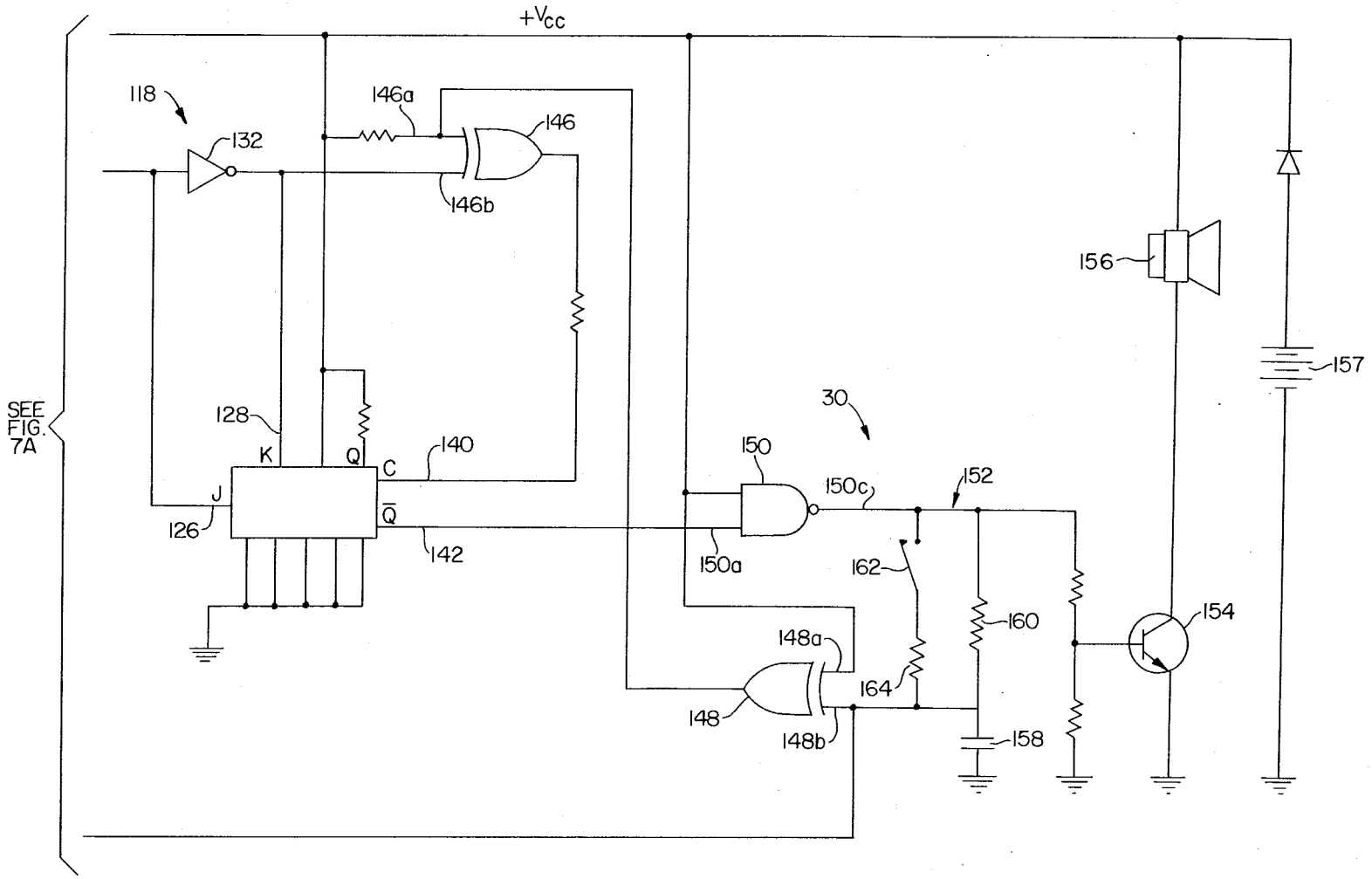

FIGS. 7A and 7B show the latch and alarm circuits carried by the control box 12. The specific embodiment of the control box circuits shown in FIGS. 7A and 7B is adapted to be connected directly to either one or two manifold units 14, the latter configuration being shown in FIG. 1. Each of the manifold units directly connected to the control box may, of course, be serially connected in turn to a plurality of additional manifold units, also as shown schematically in FIG. 1.

The circuit of FIGS. 7A and 7B includes two input jacks 43*a* and 34*b* for receiving plugs (not shown in these FIGS.) attached to the manifold units 14.

The latch circuit of FIGS. 7A and 7B has an input section 100 comprising five exclusive OR (XOR) gates 101–105. The inputs to section 100 comprise the alarm signals and $+V_{cc}$ sense signals from lugs 34*a* and 34*b*. The output of section 100 appears at the output 105*c* of gate 105. This output changes state in response to any change in the state of any of the inputs. More specifically, the alarm signal line 106 and $+V_{cc}$ sense line 108 from plug 34*a* are connected to input 102*a* of gate 102 and input 101*b* of gate 101, respectively. Similarly, the alarm signal line 101 and the $+V_{cc}$ sense line 112 from plug 34*b* are connected to input 102*b* of gate 102 and input 103*b* of gate 103, respectively. Inputs 101*a* and 103*a* are coupled to the $+V_{cc}$ power supply and are therefore normally held "high".

The outputs of gates 101 and 102 are applied to gate 104 whose output, along with that of gate 103, are connected as inputs to gate 105. Assuming as an initial condition that all inputs to XOR gates 101 and 103 are "high" and that the alarm signal inputs to gate 102 are "low", the output at 105*c* will be "low". If now one ofthe alarm inputs goes "high", the output at 105*c* will switch to its "high" state.

The output 105*c* is used to control the state of a latching circuit 118 including a dual JK flip-flop 120 which may be a standard IC designated as an MC14027B. The flip-flop 120 is arranged as a D-type flip-flop in that its J and K inputs 122 and 124 and 126 and 128 are coupled by inverters 130 and 132, respectively, so that the K input is always the compliment of the J input. The first stage of the flip-flop 120 has a clock terminal (C) 134. The output (Q) 136 of the first stage of the flip-flop 120 and the output of the inverter 130 are supplied to an exclusive OR gate 138 whose output is applied as the input to the second stage of the flip-flop 120. The second stage of the flip-flop 120 has a clock terminal (C) 140 and an output (Q) 142 which controls the alarm circuit 30.

The clock terminal 134 is coupled to the output of an exclusive OR gate 144, an input 144*b* of which is grounded. The clock terminal 140 is controlled by an XOR gate 146 having one input 146*a* coupled to the output of an XOR gate 148 and another input 146*b* coupled to the output of the inverter 132.

The alarm circuit 30 includes a NAND gate 150 arranged to function as an inverter whose input 150*a* is controlled by the output 142 of the flip-flop 120. The alarm circuit further includes a time-out circuit 152 and a transistor 154 in series with an alarm 156 and a $+V_{cc}$ supply 157. The time-out circuit 152 comprises a series RC circuit including a capacitor 158 and a resistor 160 coupled between the output of the NAND gate 150 and ground. The resistor 160 is situated by the series combination of a switch 162 and a resistor 164 of relatively low resistance compared to resistor 160. Accordingly, the time constant of the time-out circuit and the time interval of alarm energization is determined by switch 162 and when that switch is closed the capacitor 158 is charged substantially more rapidly. The upper terminal of capacitor 158 is connected to input 148*b* of XOR gate 148; the other input 148*a* of that gate is held at $+V_{cc}$ supply level, that is, "high". Capacitor 158 is also connected to input 144*a* of XOR gate 144 whose other input 144*b* is grounded.

In addition to the local alarm 156 contained in the control box, or in place thereof, it will be obvious that a remote alarm, either directly wired to the control box or associated with a radio transmitter responsive to the output of NAND gate 150 may be used to alert personnel at a remote location of any tampering with the security system or the protective merchandise.

In the operation of the latch and alarm circuits in the control box 12, it will be assumed that output 105*c*, and the associated input to the flip-flop 120, is initially in the "low" state. WIth the alarm off, terminals 144*a*, 148*b* and 150*c* are "low"; consequently clock terminals 134 and 140 of flip-flop 120 are both "low" and the flip-flop outputs 136 and 142 are both "high". In response to an alarm signal from any of the manifold units, the input to the flip-flop 120 switches to the "high" state setting flip-flop 120 so that its output 142 goes low enabling the NAND gate 150 thereby activating the alarm and initiating charging of the timing capacitor 158 at a rate dependent upon the position of switch 162. When the voltage aross the capacitor reaches the high threshold level of gates 144 and 148 the flip-flop 120 is reset via clock inputs 134 and 140, the alarm is deactivated and the system is in its stand-by mode.

Figure 8:
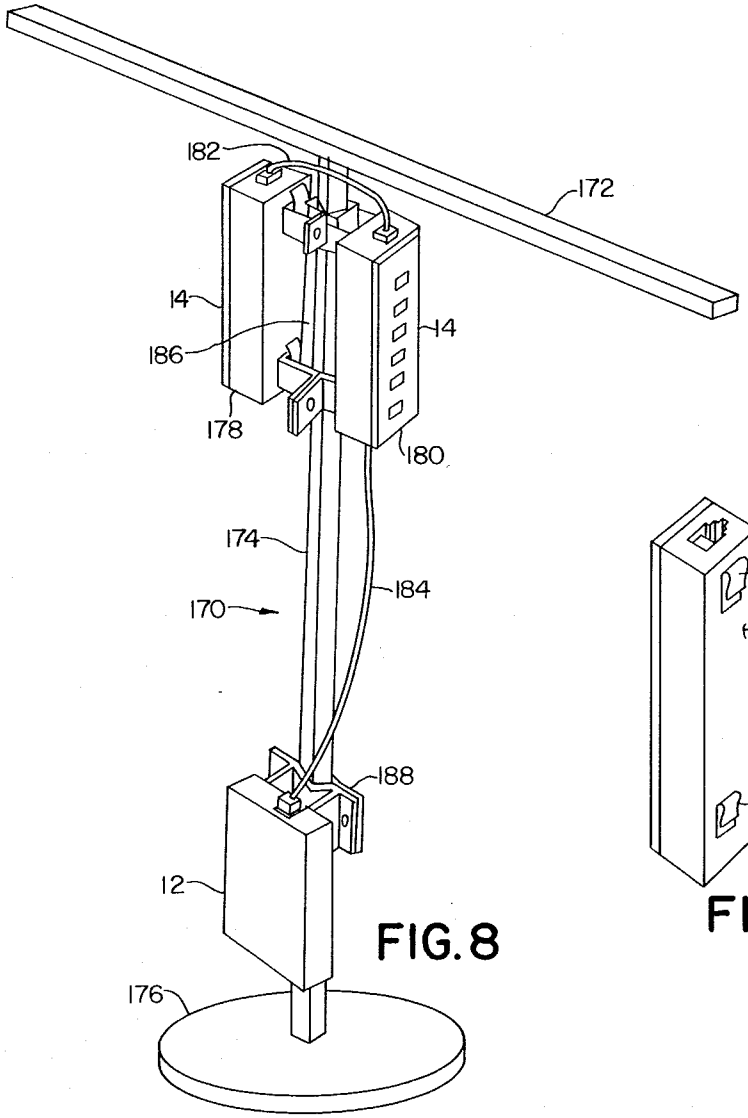
FIG. 8 is a perspective view of a T-stand having the security system of FIG. 1 mounted thereon.

FIG. 8 depicts a T-stand display incorporating the security system 10 therein. A T-stand 170 is conventional design includes a generally horizontally disposed cross bar 172 supported at an intermediate location thereon by a generally vertical support shaft 174 mounted on a supporting base 176 at the lower end thereof. The portions of the cross bar 172 extending on opposite sides of the support shaft 174 are adapted to have articles of clothing hung therefrom. The articles of clothing are omitted from FIG. 8 for simplicity of illustration. In actual practice, however, clothing articles such as the jacket 62 shown in FIG. 3 would have their hangers 64 hung directly on the cross bar 172 or on an apparatus attached thereto. The loops 16 coupled to such articles of clothing would be plugged into both of an opposite pair the manifold units 14. In this example, the manifold units 14 are coupled in series to the control box 12 such that a left-hand one 178 of the manifold units 14 is coupled to a right-hand one 180 of the manifold units 14 by a releasable cable 182. The right-hand one 180 of the manifold units 14 is coupled via a releasable cable 184 to the control box 12.

Figure 10:
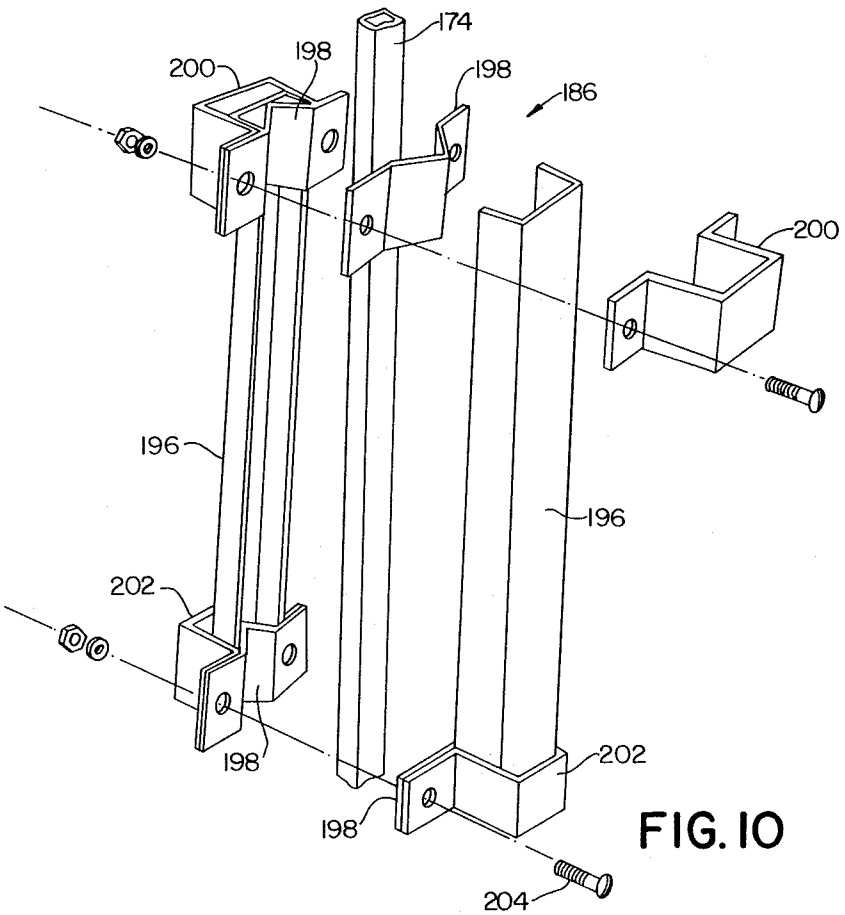
FIG. 10 is a perspective, exploded view of a bracket arrangement forming a part of the arrangement of FIG. 8 for mounting a pair of the manifold units.
Figure 9:
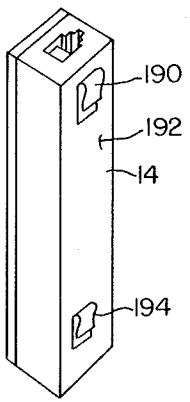
FIG. 9 is a perspective view of one of the manifold units of the arrangement of FIG. 8 having clips secured thereto to facilitate mounting.

The left and right manifold units 178 and 180 are mounted on the support shaft 174 immediately below the cross bar 152 by a bracket assembly 186 which s shown in detail in FIG. 10. The control box 12 is mounted on the support shaft 174 by a bracket arrangement 188 which may comprise a portion of the bracket assembly 186 shown in FIG. 10. FIG. 9 shows the manner in which each of the manifold units 14 is provided with a pair of clps to facilitate coupling to the bracket arrangement 186.

One of the manifold units 14 is shown in FIG. 9. The manifold unit 14 has a first clip 190 mounted on a back surface 192 of the manifold unit 14 adjacent an upper end of the manifold unit 14. A second clip 194 is mounted on the back surface 192 at the opposite lower end of the manifold unit 14.

The bracket assembly 186 (FIG. 10) includes an opposed pair of channels 196, a pair of V-shaped clamps 198 at the upper and lower ends of the pair of channels 196, and a pair of rectangular brackets 200 and 202 in alignment with each pair of V-shaped clamps 198. Screw fasteners 204 passing through ears on the V-shaped clamps 198 and brackets 200, 202, secure the bracket assembly 186 to the vertical support shaft 174. The manifolds 14 are mounted on the bracket assembly 186 by means of the clips 190 and 194 which engage the brackets 200 and 202, respectively.

Figure 13:
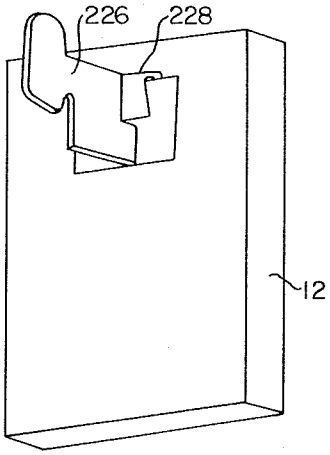
FIG. 13 is a perspective view of the control box of the arrangement of FIG. 11 illustrating the mounting bracket therefor in detail.
Figure 12:
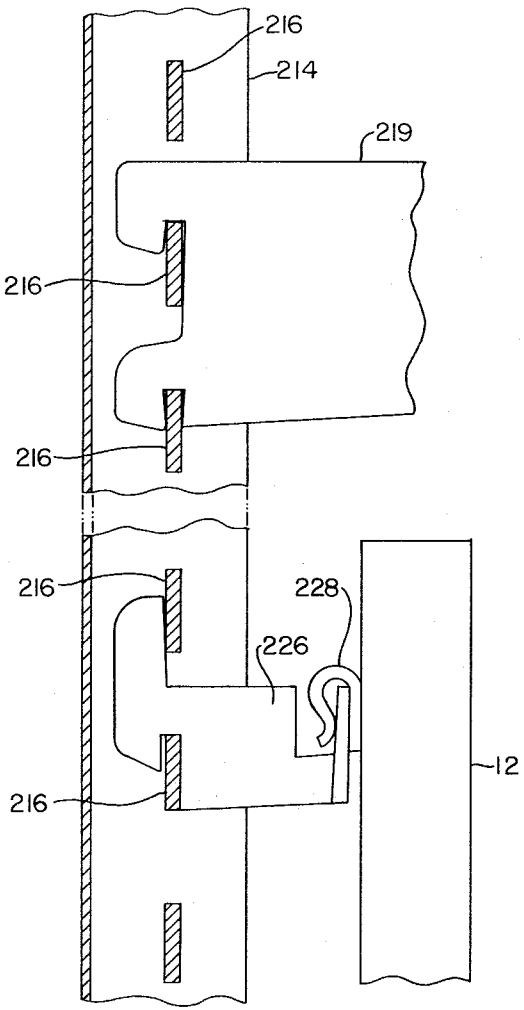
FIG. 12 is a sectional view of a portion of the arrangement of FIG. 11 illustrating the manner in which the manifold unit mounting members and the control box are mounted.
Figure 11:
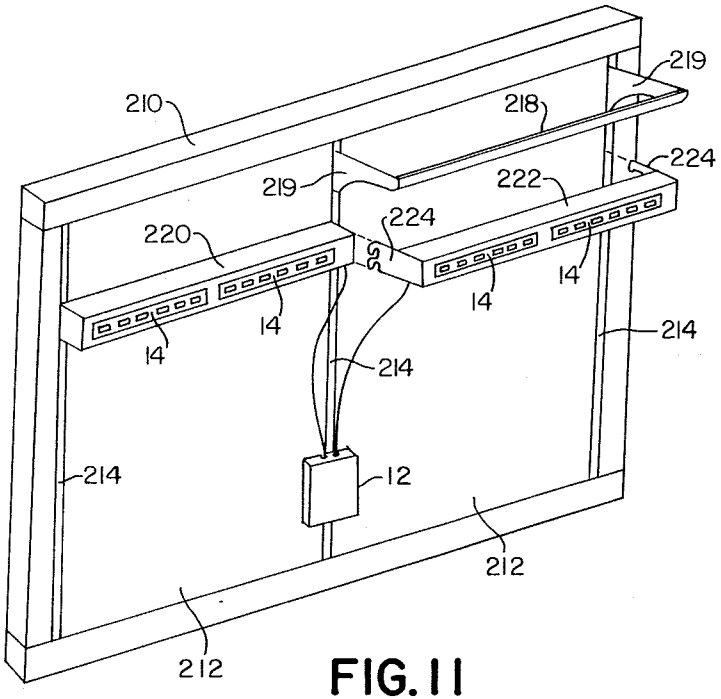
FIG. 11 is a perspective view of a wall mount arrangement including the security system of FIG. 1.

FIGS. 11–13 shows the electronic security system of the present invention mounted on a standard wall display 210 for supporting garments. The portion of the display 210 shown in the drawings includes front panels 212 separated by vertical channels 214 having internal cross-members 216 spaced along the length of the channels. The channels 214 are designed to carry clothing support bars at selected heights; one such bar 218 is shown. The bar 218 includes end brackets 219 shaped to engage adjacent pairs of channel cross-members 216. (FIG. 12.)

The security system of FIGS. 11–13 includes housings 220 and 222 each carrying a pair of manifolds 14 serially connected inside the housing in the manner previously described. End brackets 224, similar to the brackets 219, on the housings 220, 222 are used to mount the housings on the channel cross-members 216 as shown in FIG. 12. Each pair of manifolds 14 is coupled to a control box 12 which is attached, by means of a bracket 226, to the cross-members 216 below the housings 220, 222. As shown in FIG. 13, the control box 12 is attached to the bracket 226 by a clip 228 bonded to the control box.

What is claimed is:

1. A security system comprising the combination of:

a plurality of electrical circuits, each designed to physically interconnect with a different article to be secured;

means coupled to each of the plurality of electrical circuits for sensing each change of state of any of the plurality of electrical circuits, a change of state of an electrical circuit being producted by connection of the electrical circuit and also being produced by disconnection of the electrical circuit, and the means for sensing providing a change of state signal upon sensing of a change of state; and means responsive to change of state signal from the means for sensing for activating an alarm.

2. The invention set forth in claim 1, wherein the means for activating an alarm includes a bistable circuit normally assuming a first state and coupled to be changed to a second state in response to a change of state signal, an alarm coupled to be activated when the bistable circuit assumes the second state, and a time-out circuit responsive to activation of the alarm for changing the bistable circuit back to the first state a predetermined period of time after activation of the alarm.

3. The invention set forth in claim 2, wherein the time-out circuit includes separate means for defining two different predetermined periods of time and switching means for selecting one of the two different predetermined periods of time.

4. The invention set forth in claim 1, wherein each of the plurality of electrical circuits comprises a conductive sensor loop designed to be passed through a portion of an article to be secured and then connected to itself, whereby removal of the article from the loop requires disconnection of the loop from itself.

5. The invention set forth in claim 4, wherein the means for sensing includes a detection circuit having a plurality of input terminals and an output terminal, the detection circuit being operative to provide a change of state signal at the output terminal thereof whenever the loop of any of the plurality of electrical circuits is coupled to an associated one of the plurality of input terminals and to provide a change of state signal at the output terminal thereof whenever the loop of any of the plurality of electrical circuits is uncoupled from an associated one of the plurality of input terminals.

6. The invention set forth in claim 4, wherein the means for sensing includes at least one exclusive OR circuit having a pair of input terminals and an output terminal, each of the pair of input terminals undergoing a change in a signal condition thereat when a different one of the loops is coupled thereto and also when a different one of the loops is uncoupled therefrom, and the exclusive OR circuit being operative to change a signal condition at the output terminal thereof when the signal condition at one of the pair of input terminals thereof changes.

7. A modular security system comprising the combination of:

a plurality of electrical loops, each having a releasable connector and designed to physically interconnect with a different article to be secured;

a plurality of manifolds units, each having a different group of the plurality of electrical loops coupled thereto by the releasably connectors of the electrical loops and operative to provide a change of state signal in response to each change in the connection of an electrical loop thereto including coupling of the electrical loop thereto and uncoupling of the electrical loop therefrom;

a control box having an alarm therein and responsive to a change of state signal from any of the plurality of manifold units to activate the alarm; and means for releasably connecting the plurality of manifold units to the control box.

8. The invention set forth in claim 7, wherein the releasable connector of each of the electrical loops comprises a plug, each of the manifold units is provided with a plurality of jacks for receiving the plugs of a group of the plurality of electrical loops, and the means for relesably connecting comprises a plurality of cables having plugs at opposite ends thereof and jacks within each of the plurality manifold units and the control box for receiving the plugs.

9. The invention set forth in claim 7, wherein each of the electrical loops is comprised of a length of electrical cable having the releasable connector coupled to one of a pair of opposite ends thereof, a jack coupled thereto at a location along the length thereof and a plug coupled to the other one of the pair of opposite ends thereof, the plug being inserted in the jack to complete the electrical loop.

10. The invention set forth in claim 7, wherein at least two of the plurality of manifold units are electrically coupled in series to the control box by the means for releasably connecting.

11. The invention set forth in claim 7, wherein at least two of the plurality of manifold units are electrically coupled in parallel to the control box by the means for releasably connecting.

12. A security system comprising the combination of:

a plurality of conductive loops, each designed to pass through a portion of a different article to be secured;

a first plurality of exclusive OR circuits, each adapted to be coupled to a different pair of the plurality of loops and operative to provide an indication when one of the pair of loops is coupled thereto and also when one of the pair of loops is uncoupled therefrom;

a second plurality of exclusive OR circuits coupled to the first plurality of exclusive OR circuits and to each otehr and operative to provide a change of state signal at an output thereof in response to an indication from one of the first plurality of exclusive OR circuits;

an alarm; and a flip flop circuit normally assuming a first state and coupled to activate the alarm when switched to a second state, the flip flop circuit being opeative to switch to the second state in response to a change of state signal at the output of the second plurality of exclusive OR circuits.

13. The invention set forth in claim 12, further including a time-out circuit responsive to actuation of the alarm for changing the flip flop circuit to the first state after a predetermined delay, whereby the alarm is activated for a predetermined period of time when the flip flop circuit is switched to the second state.

14. A clothing display T-stand having a security system and comprising the combination of:

a generally vertically disposed support shaft mounted on a base;

a generally horizontally disposed crossbar coupled to the top of the support shaft at an intermediate portion of the crossbar and adapted to have articles of clothing hung therefrom;

at least one manifold unit mounted on the support shaft;

a plurality of conductive loops adapted to be coupled to the at least one manifold unit and to extend through portions of articles of clothing hung from the cross-bar, the manifold unit being operative to provide a signal in response to a change of state in the coupling of one of the plurality of loops thereto; and a control box mounted on the support shaft and electrically coupled to the manifold unit, the control box including an arm and circuitry for activating the alarm in response to a signal from the manifold unit.

15. The invention set forth in claim 14, wherein the at least one manifold unit and the control box are mounted on the support shaft by first and second bracket arrangements respectively so as to be disposed adjacent and generally parallel to the support shaft.

16. The invention set forth in claim 15, further including a second manifold unit mounted on the support shaft by the first bracket arrangement, the second manifold unit being disposed adjacent and generally parallel to the support shaft on the opposite side of the support shaft from the at least one manifold unit.

17. The invention set forth in claim 14, wherein the control box has a clip secured thereto and is mounted on the support shaft by a bracket arrangement secured to the support shaft and having a bracket receiving the clip.

18. The invention set forth in claim 14, wherein the at least one manifold unit has a pair of clips secured thereto adjacent opposite ends thereof and is mounted on the support shaft by a bracket arrangement secured to the support shaft and having an opposite pair of brackets receiving the pair of clips.

19. The invention set for in claim 18, wherein the bracket arrangement comprises first and second pairs of clamps disposed in spaced-apart relation along the support shaft, the clamps on each of the first and second pairs being disposed on opposite sides of the support shaft and secured together, a pair of elongated channels disposed on opposite sides of the support shaft and extending between the first and second pairs of clamps, the opposite pair of brackets being mounted on the opposite ends of the pair of elongated channels and a second pair of brackets being mounted on the opposite ends of the other one of the apir of elongated channels.

20. The invention set forth in claim 19, wherein the support shaft has a generally square cross-sectional shape and each of the clamps comprising the first and second pairs of clamps has a generally V-shaped portion thereof for mating with the side of the support shaft.

21. A clothing display wall arrangement having a security system and comprising the combination of:

a plurality of spaced-apart, generally vertically disposed slotted support tubes;

a hanging arrangement mounted on and extending between an adjacent pair of the support tubes and adapted to have articles of clothing hung therefrom;

an elongated manifold unit mounting member disposed adjacent the hanging arrangement and having an opposite pair of brackets secured to the adjacent pair of the support tubes;

at least one manifold unit mounted in the manifold unit mounting member;

a plurality of conductive loops adapted to be coupled to the at least one manifold unit and to extend through portions of articles of clothing hung from the hanging arrangement, the manifold unit being operative to provide a signal in response to a change of state in the coupling of one of the plurality of loops thereto; and a control box mounted on one of the adjacent pair of the support tubes and electrically coupled to the at least one manifold unit, the control box including an alarm and circuitry for activating the alarm in response to a signal from the manifold unit.

22. The invention set forth in claim 21, wherein each of the opposite pair of brackets of the elongated manifold unit mounting member has at least one finger for engagement in a slot in an associated one of the adjacent pair of support tubes to mount the bracket thereon.

23. The invention set forth in claim 21, wherien the control box is mounted on one of the adjacent pair of the support tubes by a clip and a bracket, the clip being mounted on the control box and the bracket having a base portion engaged by the clip and a finger portion extending from the base portion and engaging a slot in the one of the adjacent pair of the support tubes.

24. A modular security system for protecting articles such as merchandise, the system comprising:

a plurality of sensors, each sensor being adapted to be attached to a protected article and undergoing a change of state when a signal therein changes from a first level to a second level and also when the signal changes from the second level to the first level;

a multi-channel sensor monitoring unit having an input, an output, and means for coupling the sensors to the monitoring unit;

a detection circuit carried by the sensor monitoring unit, the detection circuit being connected to the input, the output and the sensor coupling means, the detector circuit being responsive to a change of state of any of the sensors or of the input to generate an alarm signal and to supply the alarm signal to the output; and a control box including an alarm circuit responsive to the alarm signal at the output of the monitoring unit detection circuit, the input of the sensor monitoring unit being adapted to be coupled in series to the output of another sensor monitoring unit and the output of the sensor monitoring unit being adapted to be coupled in series to the input of another sensor monitoring unit or directly to the control box.

25. A security system, as defined in claim 24, in which:

the sensors comprise conductive loops, each loop being adapted to pass through a portion of the protected article.

26. A security system, as defined in claim 24, in which:

the control box includes a circuit for latching the alarm circuit in its activated state and a time-out circuit for controlling the duration of said alarm, the time-out circuit being switchable to provide either a long or a short alarm interval.

27. A security system comprising the combination of:

a plurality of electrical circuits, each designed to physically interconnect with a different article to be secured;

means coupled to each of the plurality of electrical circuits for sensing each change of state in each of the plurality of electrical circuits, a change of state of an electrical circuit occurring whenever a signal level in the electrical circuit changes between either of two different levels, the means for sensing providing a change of state signal upon sensing of a change of state; and means responsive to a change of state signal from the means of sensing for activating an alarm.

* * * * *

UNITED STATES PATENT AND TRADEMARK OFFICE

CERTIFICATE OF CORRECTION

PATENT NO. : 4,746,909

DATED : May 24, 1988

INVENTOR(S) : Israel et al

It is certified that error appears in the above-identified patent and that said Letters Patent is hereby corrected as shown below:

Column 1, line 64, "4,609,919" should read --4,069,919--.

Column 9, line 5, "of" should read --or--.

Column 9, line 27 "lugs" should read --plugs--.

Column 9, line 34, "101" should read --110--.

Column 9, line 45, "ofthe" should read --of the--.

Column 10, line 9, "situated" should read --shunted--.

Column 10, line 46, "is" should read --of--.

Column 11, line 1, "s" should read --is--.

Column 11, line 7, "clps" should read --clips--.

Column 13, line 25, "otehr" should read "other".

Column 13, line 61, "arm" should read --alarm--.

Column 14, line 18, "for" should read --forth--.

Column 14, line 29, "apir" should read --pair--.

Column 16, line 17, "interconnect" should read --interact--.

Signed and Sealed this

Seventh Day of March, 1989

*Attest:*

DONALD J. QUIGG

*Attesting Officer*

*Commissioner of Patents and Trademarks*